US010297400B2

(12) United States Patent
Maloney

(10) Patent No.: US 10,297,400 B2
(45) Date of Patent: May 21, 2019

(54) MULTI-POLE ELECTRICAL SWITCHING APPARATUS AND TRIP CAM ASSEMBLY THEREFOR

(71) Applicant: EATON CORPORATION, Cleveland, OH (US)

(72) Inventor: James G. Maloney, Industry, PA (US)

(73) Assignee: EATON INTELLIGENT POWER LMITED, Dublin (IE)

( * ) Notice: Subject to any disclaimer, the term of this patent is extended or adjusted under 35 U.S.C. 154(b) by 21 days.

(21) Appl. No.: 15/635,681

(22) Filed: Jun. 28, 2017

(65) Prior Publication Data

US 2019/0006131 A1 Jan. 3, 2019

(51) Int. Cl.

| | |
|---|---|
| ***H01H 3/42*** | (2006.01) |
| ***H01H 9/22*** | (2006.01) |
| ***H01H 71/10*** | (2006.01) |
| *H01H 3/32* | (2006.01) |

(52) U.S. Cl.

CPC ..... *H01H 3/42* (2013.01); *H01H 9/22* (2013.01); *H01H 71/1009* (2013.01); *H01H 2003/326* (2013.01)

(58) Field of Classification Search

CPC ..... H01H 3/42; H01H 9/22; H01H 71/1009; H01H 2003/326

USPC ..... 200/50.1, 50.32; 335/9

See application file for complete search history.

(56) References Cited

U.S. PATENT DOCUMENTS

| | | | | |
|---|---|---|---|---|
| 4,389,555 | A * | 6/1983 | Guinan | H01H 9/04 200/293 |
| 5,686,709 | A * | 11/1997 | Casagrande | H01H 71/1009 200/50.32 |
| 6,635,833 | B2 | 10/2003 | Vignaud | |
| 7,515,022 | B2 * | 4/2009 | Zindler | H01H 71/1018 335/10 |
| 7,569,784 | B2 | 8/2009 | Rakus et al. | |
| 7,646,269 | B2 | 1/2010 | Weister et al. | |
| 7,683,276 | B2 | 3/2010 | Weister et al. | |

* cited by examiner

*Primary Examiner* — Edwin A. Leon
*Assistant Examiner* — Lheiren Mae A Caroc
(74) *Attorney, Agent, or Firm* — Eckert Seamans

(57) ABSTRACT

A trip cam assembly is for a multi-pole electrical switching apparatus. The trip cam assembly includes a first trip cam, a second trip cam, and an interconnect member coupled to the first trip cam and the second trip cam.

17 Claims, 7 Drawing Sheets

MULTI-POLE ELECTRICAL SWITCHING APPARATUS AND TRIP CAM ASSEMBLY THEREFOR

CROSS-REFERENCE TO RELATED APPLICATION

This application is related to commonly assigned, concurrently filed U.S. patent application Ser. No. 15/635,665, filed Jun. 28, 2017, and entitled "ELECTRICAL SWITCHING APPARATUS, AND HOUSING ASSEMBLY AND ASSEMBLING METHOD THEREFOR".

BACKGROUND

Field

The disclosed concept relates generally to multi-pole electrical switching apparatus such as, for example, circuit breakers. The disclosed concept also relates to trip cam assemblies for multi-pole electrical switching apparatus.

Background Information

Electrical switching apparatus, such as circuit breakers, are employed in diverse capacities in power distribution systems. Multi-pole circuit breakers, for example, typically include housing assemblies that house a number of operating components of the circuit breaker (e.g., without limitation, trip cams, separable contacts, operating mechanisms that open the separable contacts, etc.). A known problem with such housing assemblies is that they require many coupling members (e.g., without limitation, rivets) in order to couple different housing members (e.g., without limitation, covers and bases) together. Employing numerous coupling members increases the cost of the circuit breaker.

There is, therefore, room for improvement in multi-pole electrical switching apparatus and in trip cam assemblies therefor.

SUMMARY

These needs and others are met by embodiments of the disclosed concept, which are directed to a multi-pole electrical switching apparatus and trip cam assembly therefor.

As one aspect of the disclosed concept, a trip cam assembly is provided for a multi-pole electrical switching apparatus. The trip cam assembly includes a first trip cam, a second trip cam, and an interconnect member coupled to the first trip cam and the second trip cam.

As another aspect of the disclosed concept, a multi-pole electrical switching apparatus is provided. The multi-pole electrical switching apparatus includes a housing assembly having a first housing member and a second housing member coupled to the first housing member, and the aforementioned trip cam assembly. The interconnect member of the trip cam assembly extends through the first housing member and the second housing member.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

As employed herein, the term "coupling member" refers to any suitable connecting or tightening mechanism expressly including, but not limited to, rivets, screws, bolts, the combination of bolts and nuts (e.g., without limitation, lock nuts), washers and nuts, zip ties, and wires ties. "Coupling members" as defined herein refer to, for example and without limitation, members that are separable from, and not integral with, the components to which they are coupled.

As employed herein, the term "one-pole coupling member" shall mean a coupling member structured to extend through only one pole of an electrical switching apparatus. For example and without limitation, wherein a pole of an electrical switching apparatus comprises two housing members (e.g., a cover and a base), a one-pole coupling member is a coupling member structured to extend through the cover and the base in order to couple the cover to the base. Additionally, wherein an individual pole of a circuit breaker has a width (e.g., without limitation, a distance from a first surface of a cover to a second surface of a base, the first and second surfaces facing in opposing directions), a one-pole coupling member has a length substantially the same as the width.

As employed herein, the term "multi-pole coupling member" shall mean a coupling member structured to extend through multiple poles of an electrical switching apparatus. For example and without limitation, wherein a multi-pole electrical switching apparatus comprises four housing members (e.g., a cover and a base for one pole of the electrical switching apparatus, and another cover and another base for another pole of the electrical switching apparatus), a multi-pole coupling member is a coupling member structured to extend through both covers and both bases in order to couple the covers and bases together. Additionally, wherein a multi-pole electrical switching apparatus has a width (e.g., without limitation, a distance from a first surface of a base of a first pole, to a second surface of a cover of a second pole, the first and second surfaces facing in opposing directions), a multi-pole coupling member has a length substantially the same as the width.

Figure 1:
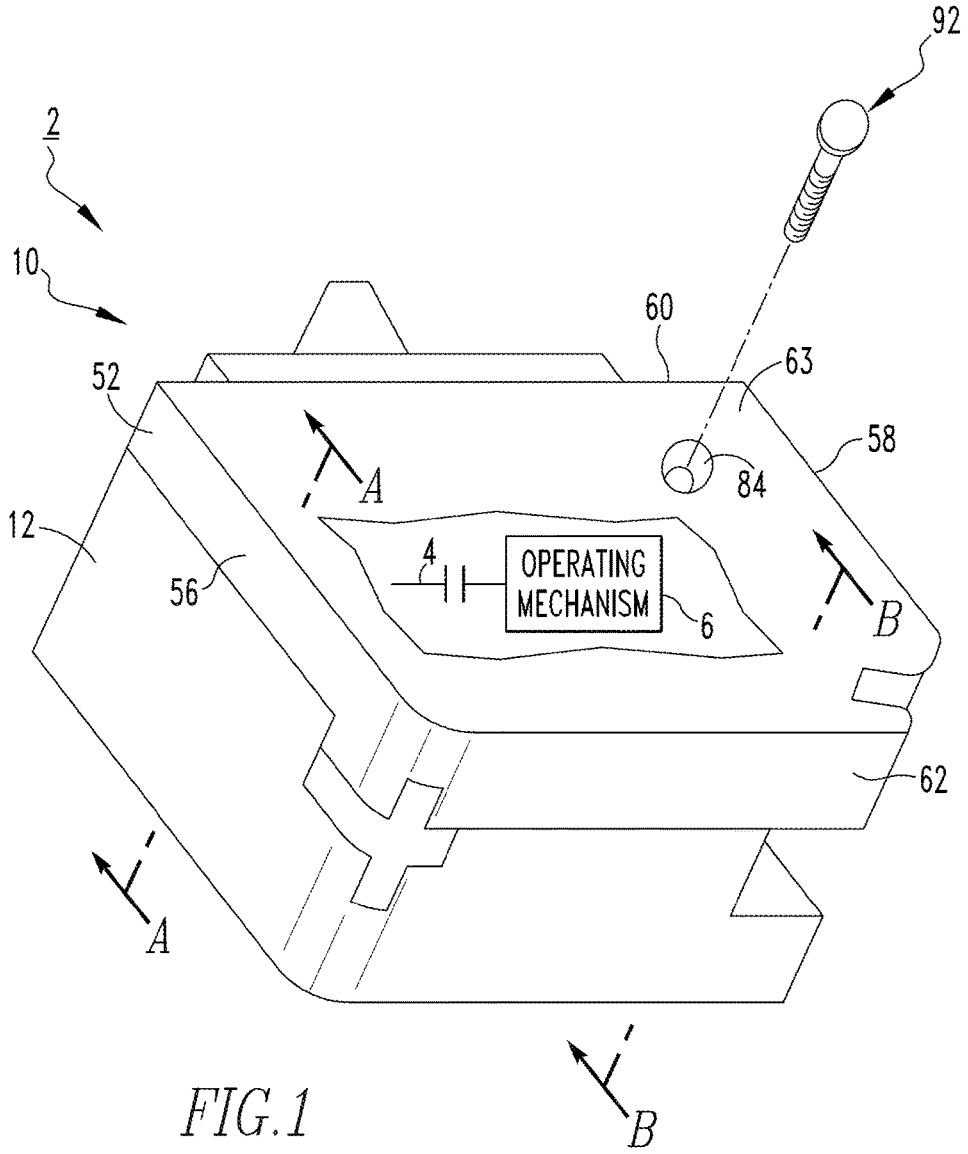
FIG. 1 is a simplified view of an electrical switching apparatus and housing assembly therefor, shown with a coupling member exploded, and shown with a portion cutaway in order to see hidden structures, in accordance with one non-limiting embodiment of the disclosed concept.

FIG. 1 is a simplified view of an electrical switching apparatus (e.g., without limitation, miniature circuit breaker 2), in accordance with one non-limiting embodiment of the disclosed concept. The example circuit breaker 2 includes a pair of separable contacts 4 (shown in simplified form), an operating mechanism 6 (shown in simplified form) for opening and closing the separable contacts 4, and a novel housing assembly 10. The housing assembly 10 includes a base 12 and a cover 52 that cooperatively enclose the separable contacts 4 and the operating mechanism 6. As will be discussed in greater detail below, the housing assembly 10 further includes only one single coupling member 92 extending through the base 12 and the cover 52 in order to couple the base 12 to the cover 52. This is distinct from prior art housing assemblies (not shown) of circuit breakers which include a plurality of coupling members extending through bases and covers to couple the bases to the covers. As such, it will be appreciated herein that the circuit breaker 2 is less expensive to manufacture than prior art circuit breakers.

Figure 2:
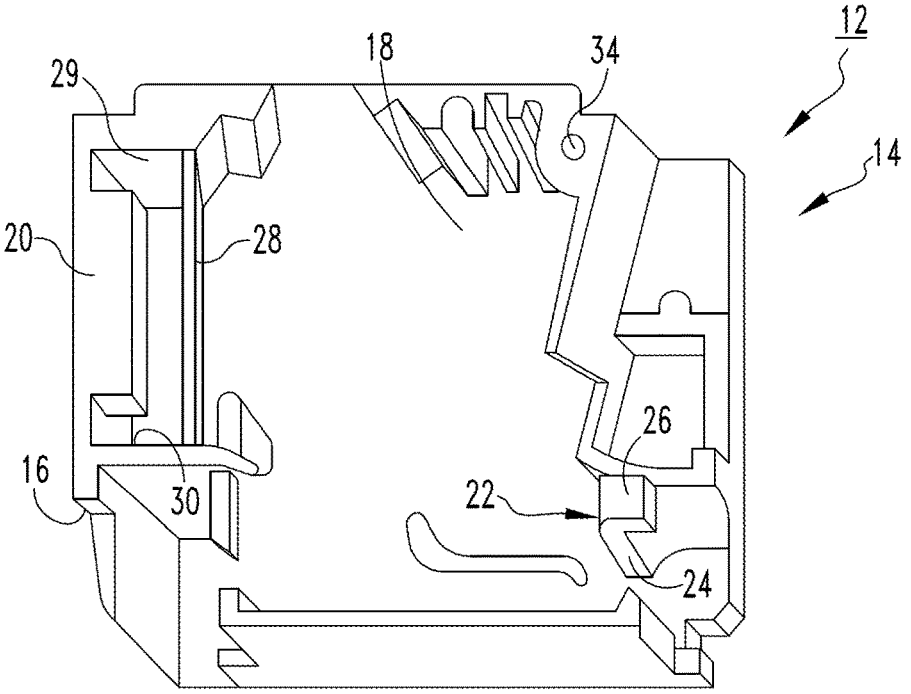
FIG. 2 is a top isometric view of a base for the electrical switching apparatus and housing assembly therefor of FIG. 1.
Figure 3:
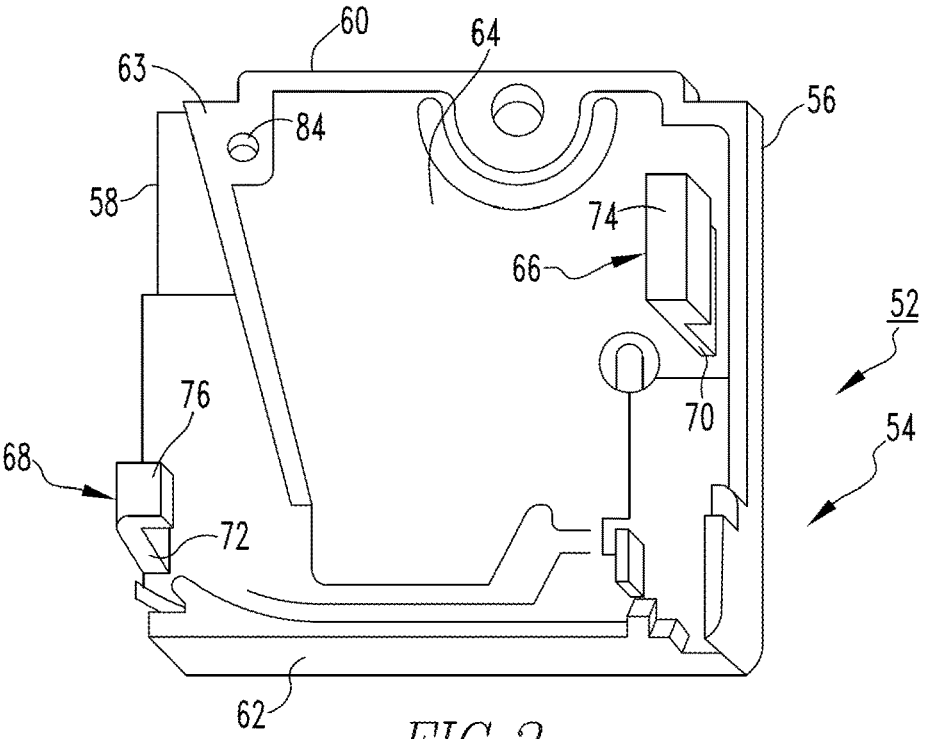
FIG. 3 is a top isometric view of a cover for the electrical switching apparatus and housing assembly therefor of FIG. 1.

FIG. 2 is a top isometric view of the base 12 and FIG. 3 is a top isometric view of the cover 52. In one example embodiment, the base 12 and the cover 52 are each unitary components made from a single piece of material. Referring to FIG. 2, the base 12 includes a body portion 14 having a generally rectangular-shaped peripheral portion 16 and a floor portion 18 located internal with respect to the peripheral portion 16. Additionally, the base 12 has a number of latching portions (see, for example, generally rectangular-shaped ledge 20 and latching portion 22) extending outwardly from the body portion 14. The ledge 20 extends from the peripheral 16 in a direction parallel with the floor portion 18. The latching portion 22 includes an extension portion 24 extending from the floor portion 18 in a direction generally perpendicular with the floor portion 18, and a hook portion 26 extending from the extension portion 24. The base 12 also includes a generally planar wall portion 28 extending from the floor portion 18 and being located generally perpendicular with respect to the floor portion 18. As shown in FIG. 2, the peripheral portion 16, the ledge 20, the wall portion 28, and a number of opposing internal surfaces 29,30 of the base 12 define a thru hole (e.g., to the left of the wall portion 28 in FIG. 2) in the base 12. It will be appreciated that this thru hole advantageously provides a mechanism to allow the base 12 to be manufactured by an injection molding process.

Referring to FIG. 3, the cover 52 includes a body portion 54 having first and second opposing peripheral edge portions 56, 58, third and fourth opposing peripheral edge portions 60, 62 that extend between the first and second peripheral edge portions 56, 58, and a floor portion 64 extending between the peripheral edge portions 56, 58, 60, 62. As shown, the cover 52 further includes a number of latching portions (two example latching portions 66, 68 are shown in FIG. 3) extending outwardly from the floor portion 64. The latching portions 66, 68 each include a corresponding extension portion 70, 72 extending from and being located generally perpendicular with respect to the floor portion 64, and a corresponding hook portion 74, 76 extending outwardly from the corresponding extension portion 70, 72. The extension portion 70 extends from proximate the first peripheral edge portion 56, and the extension portion 72 extends from proximate the second peripheral edge portion 58. As shown in FIG. 3, the third peripheral edge portion 60 extends from the second peripheral edge portion 58 at a junction 63. It will be appreciated that the coupling member 92 (FIG. 1) extends through the cover 52 proximate the junction 63.

Continuing to refer to FIGS. 2 and 3, the body portion 14 of the base 12 has an edge portion 34 defining a thru hole, and the body portion 54 of the cover 52 has an edge portion 84 defining a thru hole. When the circuit breaker 2 and housing assembly 10 therefor is assembled, the edge portions 34, 84 are aligned with (i.e., overlay and/or provide for a common passage through) each other and the coupling member 92 (FIG. 1) extends through the edge portions 34, 84. Furthermore, when the circuit breaker 2 and housing assembly 10 therefor is assembled, the ledge 20 of the base 12 is interlocked with the latching portion 66 of the cover 52, and the latching portion 22 of the base 12 is interlocked with the latching portion 68 of the cover 52. It will be appreciated that this interlocking between the ledge 20 and the latching portion 66, and between the latching portions 22, 68, advantageously eliminates the need for the circuit breaker 2 and housing assembly 10 therefor to have any coupling members in addition to the coupling member 92 (FIG. 1) extending through the base 12 and the cover 52.

Figure 4:
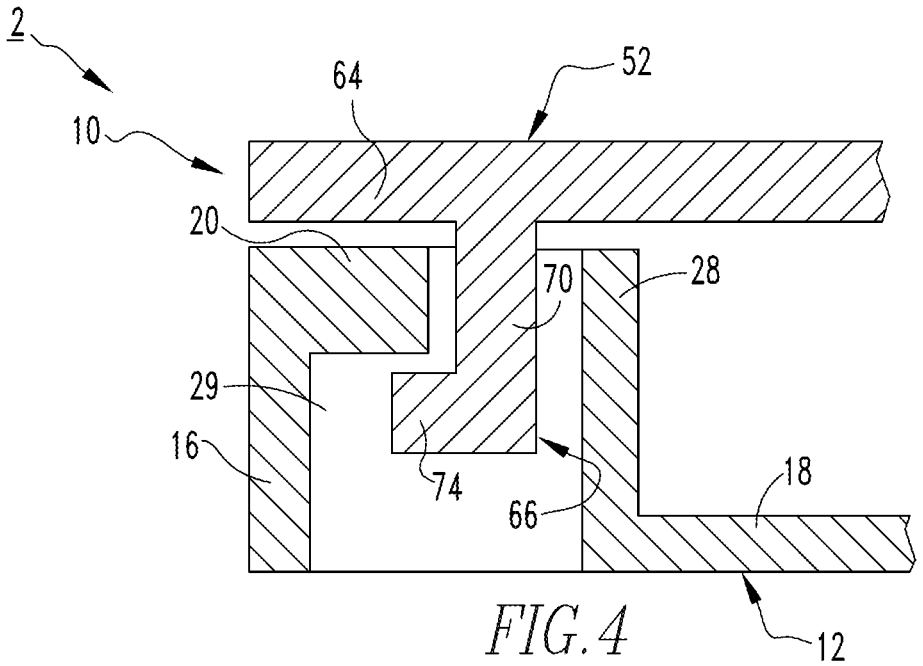
FIG. 4 is a section view of a portion of the electrical switching apparatus and housing assembly therefor of FIG. 1, taken along line A-A of FIG. 1.

More specifically, as shown in FIG. 4, the hook portion 74 of the latching portion 66 has been inserted into the thru hole of the base 12 (i.e., the thru hole defined by peripheral portion 16, ledge 20, wall portion 28, and surfaces 29, 30 (FIG. 2)) and slid laterally (i.e., moved to the left with respect to the orientation of FIG. 4) with respect to the base 12. During assembly, once the latching portion 66 is in the position shown in FIG. 4, the coupling member 92 (FIG. 1) is inserted through the edge portions 34, 84. This minimizes and/or eliminates side to side movement of the cover 52 with respect to the base 12. As such, the hook portion 74 provides a mechanism to maintain the relative position of the cover 52 with respect to the base 12. That is, if the cover 52 is caused to move upwards (with respect to the orientation of FIG. 4), or away from the base 12, the hook portion 74 will press into the ledge 20 in order to prevent such separation of components. When side to side movement of the cover 52 and the base 12 is restricted and/or minimized by the coupling member 92 (FIG. 1), this relationship between the hook portion 74 and the ledge 20 is what is meant by the two components being "interlocked" with each other.

Stated differently, a portion of the ledge 20 is located between the hook portion 74 and the floor portion 64 of the cover 52. Furthermore, the ledge 20 extends from the peripheral portion 16 toward the wall portion 28. The extension portion 70 is located between the wall portion 28 and the ledge 20. The ledge 20 is located generally perpendicular with respect to the peripheral portion 16. The hook portion 74 is located generally perpendicular with respect to the extension portion 70. As a result, when the coupling member 92 (FIG. 1) is extended through the base 12 and the cover 52, the ledge 20 and the latching portion 66 provide for a relatively secure connection point, a connection point which replaces the need for at least one coupling member, thereby reducing the overall cost of the circuit breaker 2 and housing assembly 10 therefor.

Also shown in FIG. 4, the wall portion 28 of the base 12 extends from the floor portion 18 of the base 12 to proximate the floor portion 64 of the cover 52. As a result, it will be appreciated that the wall portion 28 advantageously functions as a barrier to protect operators from potential exposure to live and/or energized components (not shown) located within the circuit breaker 2. As such, while the thru hole defined by peripheral portion 16, ledge 20, wall portion 28, and surfaces 29, 30 allows for the base 12 to be manufactured via injection molding, the wall portion 28 functions to enclose a side of the circuit breaker 2 proximate the ledge 20 so that the potential for contact with live and/or energized components (not shown) within the circuit breaker 2 is relatively low.

Figure 5:
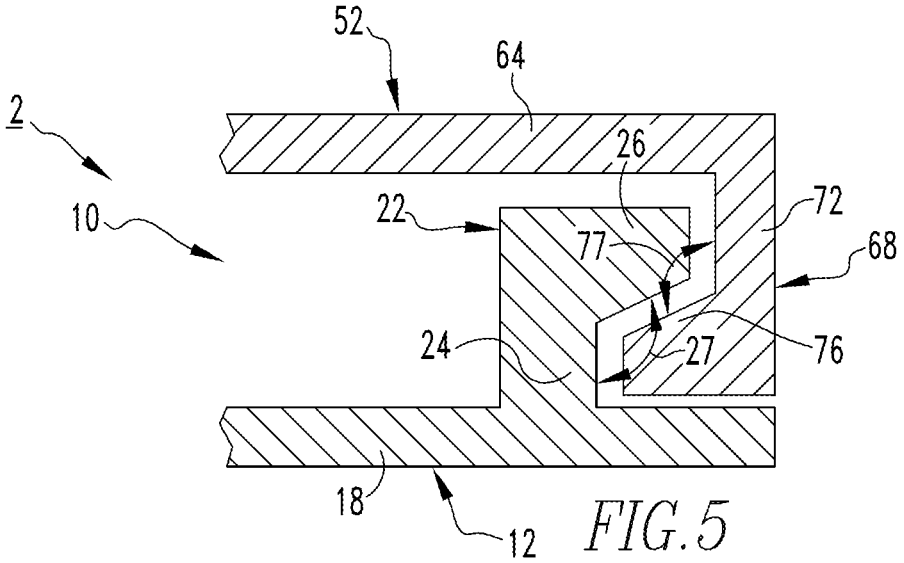
FIG. 5 is a section view of another portion of the electrical switching apparatus and housing assembly therefor of FIG. 1, taken along line B-B of FIG. 1.

Similar to the interlocking of the ledge 20 and the latching portion 66, the latching portion 22 of the base 12 is interlocked with the latching portion 68 of the cover 52, as shown in FIG. 5. That is, if the cover 52 is caused to move upwards (with respect to the orientation of FIG. 5), or away from the base 12, the hook portion 76 will press into the hook portion 26 in order to prevent such separation of components. Stated differently, a portion of the hook portion 26 of the base 12 is located between the hook portion 76 of the cover 52 and the floor portion 64 of the cover 52. Accordingly, the interlocking between the latching portions 22, 68 functions as a relatively secure connection point, a connection point which replaces the need for at least one coupling member, thereby reducing the cost of the circuit breaker 2.

As mentioned above, the circuit breaker 2 and housing assembly 10 therefor includes only (i.e., no more than) the one single coupling member 92 extending through the base 12 and the cover 52. Prior art electrical switching apparatus (not shown), such as miniature circuit breakers, typically employ four coupling members to couple the base to the cover. This translates to a reduction in costs equal to the cost of three coupling members per circuit breaker. By way of one non-limiting example, if the coupling members are rivets that cost $0.0096/rivet, this translates into a cost savings of $0.0288/miniature circuit breaker (i.e., ($0.0096/rivet) times three rivets removed per miniature circuit breaker). It will be appreciated, therefore, that when large volumes of circuit breakers are manufactured, this cost savings is significant.

Continuing to refer to FIG. 5, it will be appreciated that the hook portions 26, 76 each extend at corresponding obtuse angles 27, 77 from their corresponding extension portions 24, 72. As a result, assembly of the circuit breaker 2 and housing assembly therefor is simplified in that the interlocking of the latching portions 22, 68 can be accomplished with a degree of forgiveness. That is, when the cover 52 slides laterally with respect to the base 12 during assembly, the hook portion 76 does not need to fit exactly under the hook portion 26, but rather is provided with some tolerance by virtue of the fact that the hook portions 26, 76 extend at obtuse angles 27, 77 from the extension portions 24, 72.

It will thus be appreciated that a method of assembling the electrical switching apparatus 2 includes the steps of providing a housing assembly 10 with the electrical switching apparatus 2, the housing assembly 10 having a base 12 and a cover 52 each comprising a body portion 14, 54 and at least one latching portion 20, 22, 66, 68 extending outwardly from the body portion 14, 54, each corresponding body portion 14, 54 having an edge portion 34, 84 defining a thru hole; overlaying the cover 52 onto the base 12 such that the at least one latching portion 66, 68 of the cover 52 is located adjacent the at least one latching portion 20, 22 of the base 12, the base 12 and the cover 52 cooperatively enclosing the pair of separable contacts 4 and the operating mechanism 6; sliding the cover 52 laterally with respect to the base 12 such that the edge portion 34 of the base 12 and the edge portion 84 the cover 52 move into alignment with each other; and inserting only one single coupling member 92 through the base 12 and the cover 52, the coupling member 92 extending through the edge portion 34 of the base 12 and the edge portion 84 of the cover 52 in order to couple the base 12 to the cover 52. The method may further include the step of sliding the cover 52 such that at least a portion of the at least one latching portion 20, 22 of the base 12 is disposed between the hook portion 74, 76 and the body portion 54 of the cover 52.

Although the disclosed concept has been described in association with the ledge 20 being interlocked with the latching portion 66, and the latching portions 22,68 being interlocked with each other, it will be appreciated that latching portions (not shown) having suitable alternative shapes, location, size and/or orientation are contemplated herein.

Accordingly, it will be appreciated that the disclosed concept provides for an improved (e.g., without limitation, less expensive to manufacture) electrical switching apparatus 2, and housing assembly 10 and assembling method therefor, in which only one single coupling member 92 is employed to couple a base 12 and a cover 52 of the housing assembly 10 together.

Figure 6:
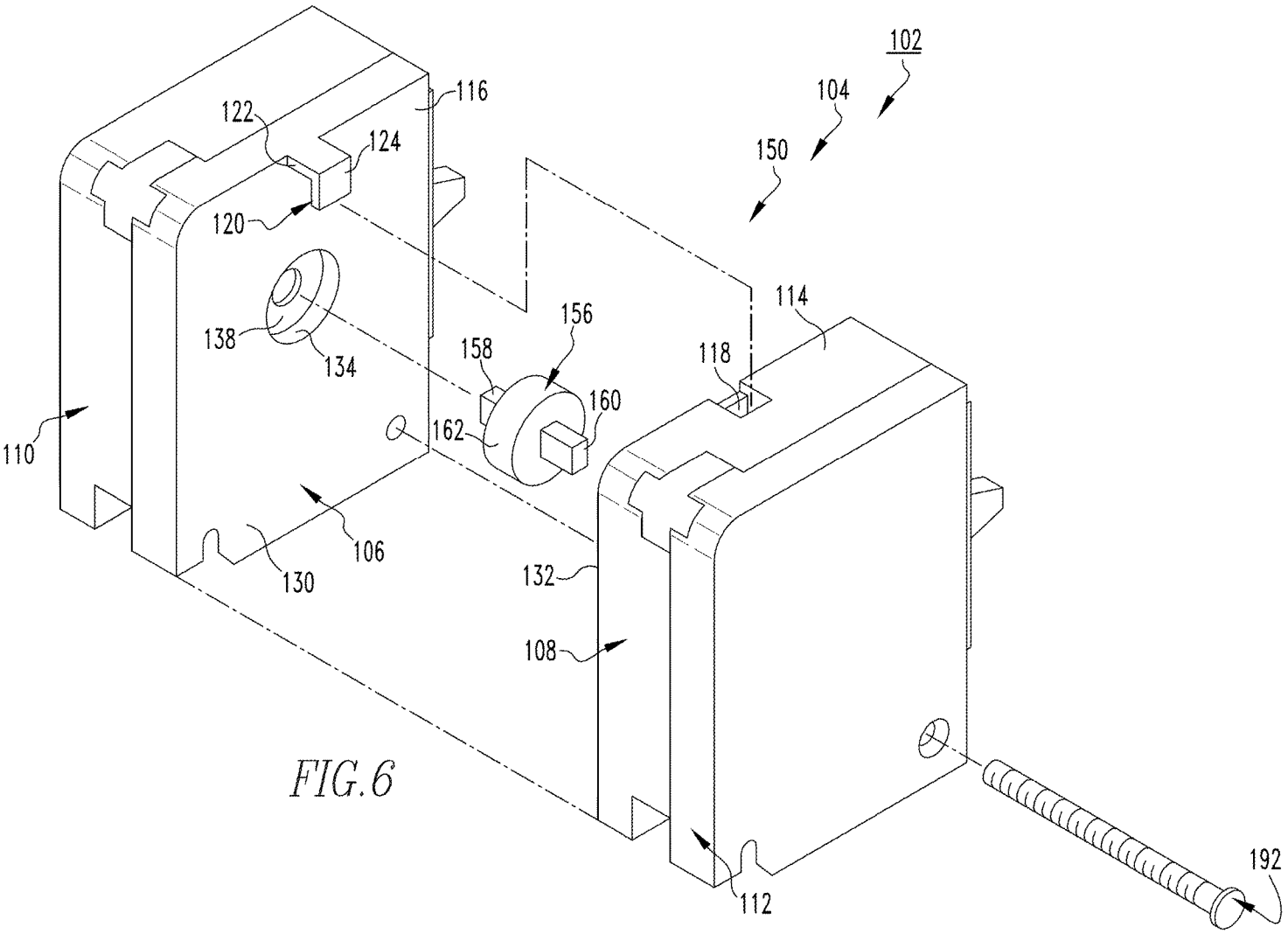
FIG. 6 is a simplified exploded view of a multi-pole electrical switching apparatus and trip cam assembly therefor, in accordance with another non-limiting embodiment of the disclosed concept.

FIG. 6 is a simplified exploded view of a multi-pole electrical switching apparatus (e.g., without limitation, two-pole circuit breaker 102), in accordance with another non-limiting embodiment of the disclosed concept. The example circuit breaker 102 includes a housing assembly 104 and a trip cam assembly 150. The housing assembly 104 has a number of housing members (e.g., without limitation, cover 106 and base 110 coupled to each other for one pole of the circuit breaker 102, and base 108 and cover 112 coupled to each other for another pole of the circuit breaker 102). Additionally, as shown, the circuit breaker 102 further includes only one single coupling member (e.g., without limitation, multi-pole coupling member 192) extending through the covers 106, 112 and the bases 108, 110 in order to couple the covers 106, 112 and the bases 108, 110 together. Thus, the circuit breaker 102 is devoid of one-pole coupling members. This is distinct from prior art housing assemblies (not shown) of multi-pole electrical switching apparatus which include a plurality of one-pole coupling members for each individual pole of the electrical switching apparatus, and further include a plurality of multi-pole coupling members extending through all of the bases and all of the covers in order to couple the bases to the covers. As such, it will be appreciated herein that the circuit breaker 102 is significantly less expensive to manufacture than prior art multi-pole circuit breakers.

Continuing to refer to FIG. 6, the first base 108 includes a body portion 114 having a latching portion (e.g., without limitation, pocket 118 defined in body portion 114), and the first cover 106 includes a body portion 116 and a latching portion 120 extending from the body portion 116. The pocket 118 is a recessed region defined by a number of surfaces of body portion 114. The latching portion 120 includes an extension portion 122 and a hook portion 124 extending from the extension portion 122. The extension portion 122 extends outwardly from the body portion 116 away from the second base 110. In one example embodiment, the hook portion 124 is located generally perpendicular to the extension portion 122. It will be appreciated that when the circuit breaker 102 is assembled, the latching portion 120 is interlocked with the pocket 118. More specifically, the hook portion 124 extends into and is reliably maintained within the pocket 118. It will, however, be appreciated that suitable alternative interlocking mechanisms besides the latching portions 118, 120 are contemplated herein.

Figure 7:
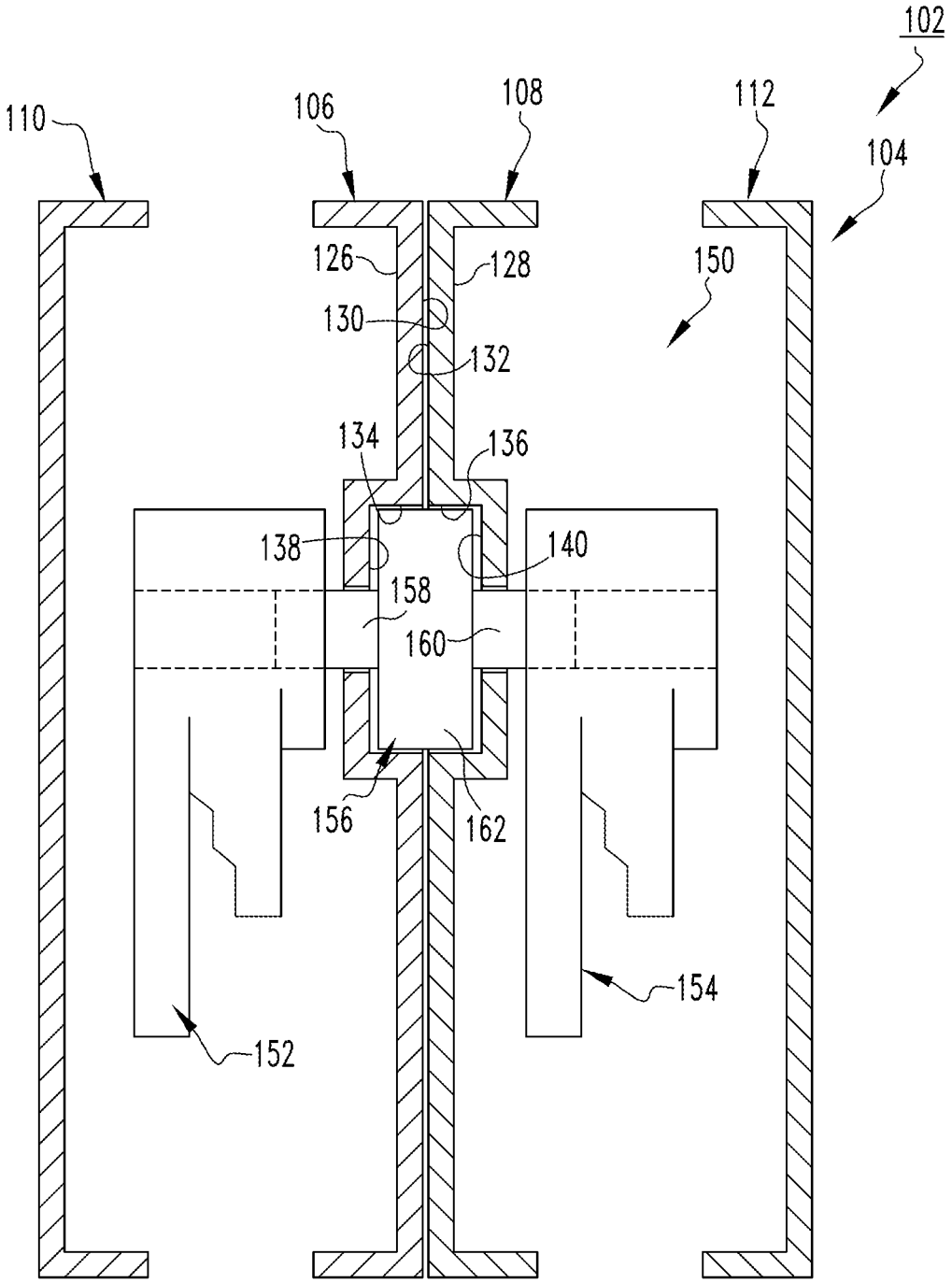
FIG. 7 is a simplified partial section view of the multi-pole electrical switching apparatus and trip cam assembly therefor of FIG. 6, shown with components assembled and with certain components not shown for ease of illustration and economy of disclosure.

FIG. 7 depicts a simplified partial section view of the circuit breaker 102, shown with components assembled and with other components (e.g., without limitation, movable contact arms, operating mechanisms, etc.) not shown for ease of illustration and economy of disclosure. As shown, the trip cam assembly 150 includes a first trip cam 152, a second trip cam 154, and an interconnect member 156 coupled to and extending between the first trip cam 152 and the second trip cam 154. The first trip cam 152 is located internal with respect to (i.e., is enclosed by and generally does not extend have any portion extending through) the cover 106 and the base 110, and the second trip cam 154 is located internal with respect to (i.e., is enclosed by and generally does not extend have any portion extending through) the base 108 and the cover 112. In one example embodiment, the first trip cam 152 is shaped the same as the second trip cam 154. As such, it will be appreciated that manufacturing/assembly of the circuit breaker 102 is simplified in that molds for only one trip cam are needed, and assemblers will not have to determine which different trip cam corresponds to a particular pole of a circuit breaker. Furthermore, in one example embodiment the first trip cam 152, the second trip cam 154, and the interconnect member 156 are each unitary components made from single pieces of material (e.g., without limitation, injection molded pieces).

Figure 8:
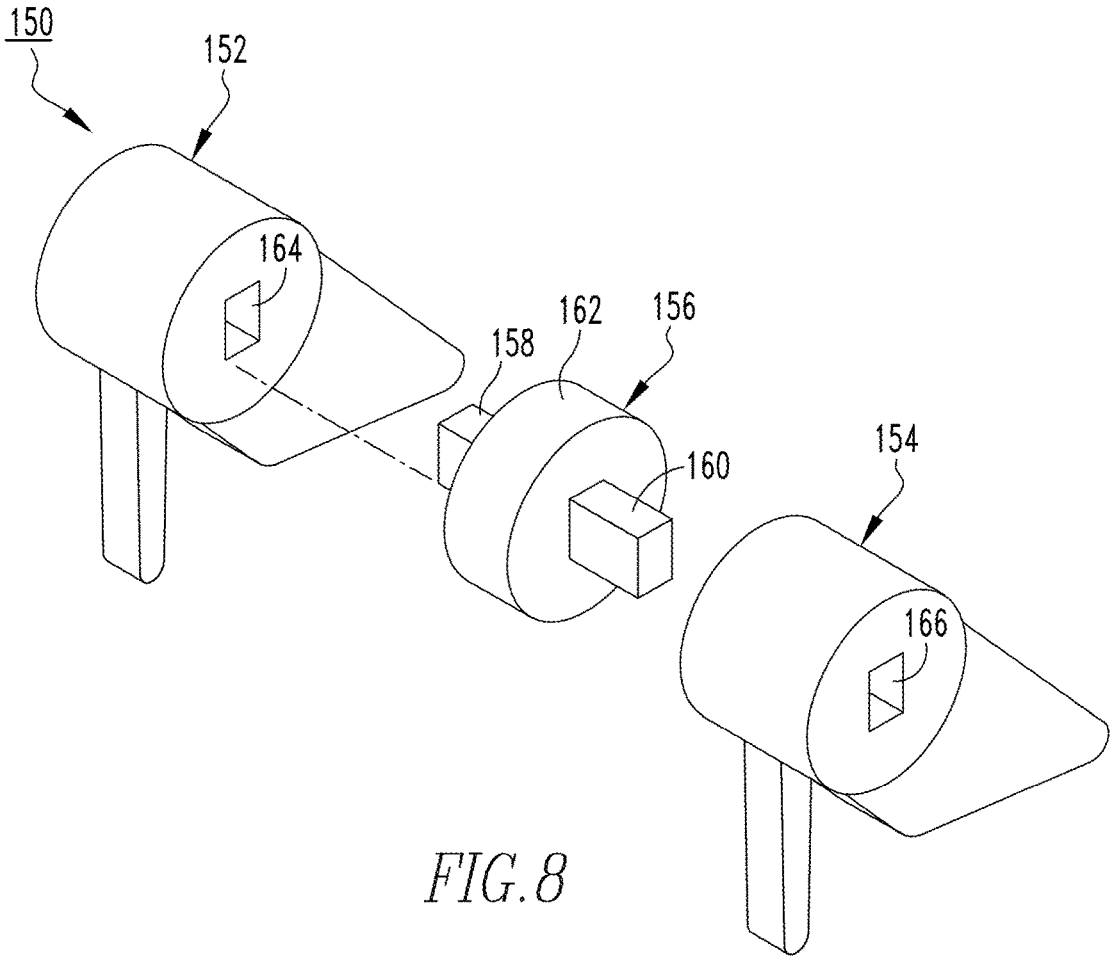
FIG. 8 is an exploded isometric view of the trip cam assembly of FIG. 7.
Figure 9:
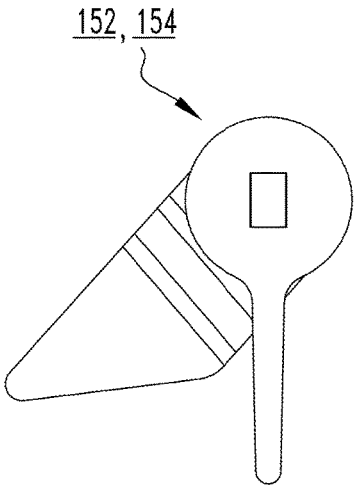
FIGS. 9-11 are left side, front, and right side views, respectively, of the trip cams for the trip cam assembly of FIG. 8.
Figure 10:
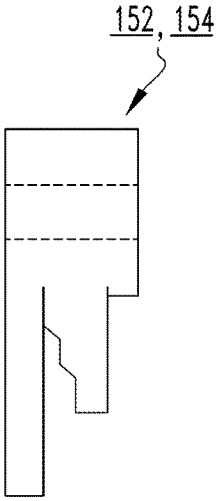
Figure 11:
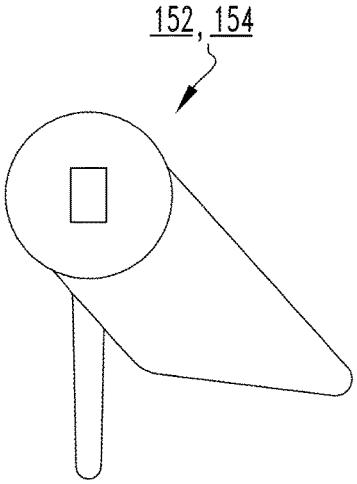
Figure 12:
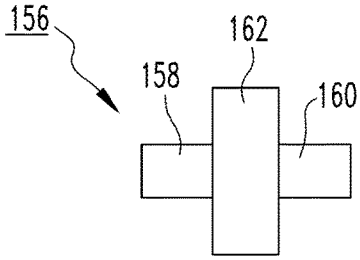
FIGS. 12 and 13 are front and right side views, respectively, of an interconnect member for the trip cam assembly of FIG. 8.
Figure 13:
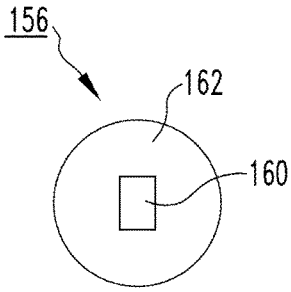

FIG. 8 shows an exploded isometric view of the trip cam assembly 150. As shown, the interconnect member 156 (also shown in FIGS. 12 and 13) includes a first shaft portion 158, a second shaft portion 160, and a disc-shaped bearing portion 162 extending from the first shaft portion 158 to the second shaft portion 160 and extending radially outwardly from the first shaft portion 158 and the second shaft portion 160. In one example embodiment, the first shaft portion 158 and the second shaft portion 160 are each rectangular-shaped. The first trip cam 152 and the second trip cam 154 (also shown in FIGS. 9-11) each have a thru hole 164,166. The thru holes 164, 166 are defined by a number of surfaces shaped to receive a corresponding one of the first and second shaft portions 158, 160 of the interconnect member 156. Accordingly, when assembled, the first shaft portion 158 extends into the thru hole 164 in order to couple the first shaft portion 158 to the first trip cam 152. The second shaft portion 160 extends into the thru hole 166 in order to couple the second shaft portion 160 to the second trip cam 154. In one example embodiment, the shaft portions 158, 160 are coupled to the respective trip cams 152, 154 by press-fit mechanisms. Although the trip cam assembly 150 has been described herein in association with the first shaft portion 158 and the second shaft portion 160 being rectangular-shaped, it will be appreciated that an interconnect member may have shaft portions having any known or suitable alternative geometry in order to perform the desired function of transmitting movement of one trip cam into movement of other trip cams. Additionally, in another example embodiment (not shown), the trip cams each have blind holes instead of thru holes.

Referring again to FIG. 7, the first cover 106 and the first base 108 each include a corresponding internal portion 126, 128 and a corresponding external portion 130, 132 facing away from the internal portion 126, 128. As shown, the bearing portion 162, which is located generally midway between the first trip cam 152 and the second trip cam 154, is structured to engage the external portions 130, 132. More specifically, the external portions 130, 132 each include a respective tubular-shaped surface 134, 136 and a respective disc-shaped surface 138, 140 extending from the tubular-shaped surface 134, 136 and being located generally perpendicular with respect thereto. The tubular-shaped surfaces 134, 136 and the disc-shaped surfaces 138, 140 define pockets, or recesses in the external portions 130, 132. The first shaft portion 158 extends through the first disc-shaped surface 138 (e.g., and through the first cover 106) and the second shaft portion 160 extends through the second disc-shaped surface 140 (e.g., and through the first base 108). Additionally, the first shaft portion 158 does not extend through the base 108, and the second shaft portion 160 does not extend through the cover 106.

It will be appreciated that in operation the bearing portion 162 of the interconnect member 156, which is generally disc-shaped, is structured to rotate against and engage the tubular-shaped surfaces 134, 136 and the disc-shaped surfaces 138, 140. Accordingly, the bearing portion 162 is not located internal with respect to the cover 106 and the base 110, and is not located internal with respect to the base 108 and the cover 112. This configuration (i.e., having the bearing portion 162 and bearing surfaces 134, 136, 138, 140 surfaces of the circuit breaker 102 and trip cam assembly 150 therefor located external with respect to individual poles of the circuit breaker 102) is distinct from prior art circuit breakers (not shown). Specifically, prior art multi-pole circuit breakers (not shown) typically have the bearing surfaces of trip cam assemblies and housing members located internal with respect to the individual poles of the circuit breaker, and generally do not have separate interconnect members, but rather have extension portions as part of the trip cams. By locating the bearing portion 162 on the external bearing surfaces 134, 136, 138, 140, the circuit breaker 102 is advantageously able to function with only the one single multi-pole coupling member 192 (FIG. 6) and without any one-pole coupling members.

More specifically, and with reference again to FIG. 6, the cover 106 and the base 110 are coupled together in a similar manner as the base 12 (FIGS. 1 and 2) and the cover 52 (FIGS. 1 and 3), discussed above. For economy of disclosure, only the coupling of the cover 106 and the base 110 will be discussed herein, although it will be appreciated that the base 108 and the cover 112 are coupled together in substantially the same manner. The internal portions of the cover 106 and the base 110 have latching portions (not shown, but see, for example, similar latching portions 20, 22, 66, 68, depicted in FIGS. 2 and 3) that interlock with one another by being slid laterally with respect to each other. Because prior art multi-pole circuit breakers (not shown) have bearing surfaces located internal with respect to the individual poles of the circuit breaker, the covers and bases of each individual pole must be assembled by being placed directly on top of one another (e.g., the trip cams of such circuit breakers must extend through the covers and bases). That is, housing assemblies of prior art multi-pole circuit breakers cannot be assembled by sliding covers/bases of individual poles laterally with respect to each other. As such, in order to achieve the desired benefits of reducing the number of necessary coupling members, the bearing portion 162 is located on the external portions 130, 132, and engages the tubular-shaped surfaces 134, 136 and the disc-shaped surfaces 138, 140.

Once the cover 106 and the base 110 (e.g., and also the base 108 and the cover 112) have had their respective internal latching portions slid laterally with respect to each other, the remaining assembly steps can be performed. More specifically, the interconnect member 156 is then preferably coupled to one of the trip cams 152, 154. Next, the hook portion 124 is inserted into the pocket 118, which provides a pivot point about which the first cover 106 and the first base 108 can be moved toward one another. Once the first cover 106 and the first base 108 have been pivoted relatively close to each other, the interconnect member 156 can be coupled to the other one of the trip cams 152, 154 by a continued pivoting motion, a motion which will result in one of the shaft portions 158, 160 extending through one of the disc-shaped surfaces 138, 140 and into a corresponding one of the thru holes 164, 166. Finally, with the hook portion 124 inserted into the pocket 118, and the trip cam assembly 150 assembled into the circuit breaker 102, the single multi-pole coupling member 192 can be inserted through the covers 106, 112 and the bases 108, 110 in order to advantageously prevent separation of the covers 106, 112 and the bases 108, 110.

It will thus be appreciated that the disclosed concept provides a novel mechanism to reduce the number of necessary coupling members in a multi-pole electrical switching apparatus such as, for example and without limitation, the circuit breaker 102. This translates into a tremendous cost savings. For example, while the circuit breaker 102 employs only the one single multi-pole coupling member 192 and zero one-pole coupling members, prior art two-pole circuit breakers (not shown) typically employ two multi-pole coupling members and four one-pole coupling members. This translates to a reduction in costs equal to the cost of one multi-pole coupling member and four one-pole coupling member per two-pole circuit breaker. By way of one non-limiting example, if the multi-pole coupling member is a two-pole coupling member, and if the coupling members are rivets that cost $0.022/two-pole rivet and $0.0096/one-pole rivet, this translates into a cost savings of $0.0604/two-pole circuit breaker (i.e., ($0.022/two-pole rivet) times one two-pole rivet removed, plus ($0.0096/one-pole rivet) times four one-pole rivets removed, per two-pole circuit breaker). As such, when large volumes of circuit breakers are manufactured, this cost savings is significant.

Accordingly, it will be appreciated that the disclosed concept provides for an improved (e.g., without limitation, less expensive to manufacture) multi-pole electrical switching apparatus 102 and trip cam assembly 150 therefor, in which only one single coupling member 192 is employed to couple a number of covers 106, 112 and a number of bases 108, 110 together.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A trip cam assembly for a multi-pole electrical switching apparatus, said trip cam assembly comprising:
- a first trip cam;
- a second trip cam; and
- an interconnect member coupled to said first trip cam and said second trip cam,
- wherein said first trip cam, said second trip cam, and said interconnect member have a common axis of rotation; wherein said interconnect member comprises a first shaft portion, a second shaft portion, and a bearing portion extending from said first shaft portion to said second shaft portion; wherein said first shaft portion is coupled to said first trip cam; wherein said second shaft portion is coupled to said second trip cam; wherein each of said first trip cam and said second trip cam has a thru hole; wherein said first shaft portion extends into the thru hole of said first trip cam in order to couple said first shaft portion to said first trip cam; and wherein said second shaft portion extends into the thru hole of said second trip cam in order to couple said second shaft portion to said second trip cam.

2. The trip cam assembly of claim 1 wherein said bearing portion is disc-shaped.

3. The trip cam assembly of claim 1 wherein each of said first shaft portion and said second shaft portion is rectangular-shaped.

4. The trip cam assembly of claim 1 wherein each of said first trip cam, said second trip cam, and said interconnect member is a unitary component made from a single piece of material.

5. The trip cam assembly of claim 1 wherein said first trip cam is shaped the same as said second trip cam.

6. The trip cam assembly of claim 1 wherein said bearing portion is disposed generally midway between said first trip cam and said second trip cam; and wherein said bearing portion extends radially outwardly from said first shaft portion and said second shaft portion.

7. A multi-pole electrical switching apparatus comprising:
- a housing assembly comprising a first housing member and a second housing member coupled to said first housing member; and
- a trip cam assembly comprising:
  - a first trip cam,
  - a second trip cam, and
  - an interconnect member coupled to said first trip cam and said second trip cam, said interconnect member extending through said first housing member and said second housing member,
- wherein said first trip cam, said second trip cam, and said interconnect member have a common axis of rotation; wherein said interconnect member comprises a first shaft portion, a second shaft portion, and a bearing portion extending from said first shaft portion to said second shaft portion; wherein said first shaft portion is coupled to said first trip cam; wherein said second shaft portion is coupled to said second trip cam; wherein each of said first trip cam and said second trip cam has a thru hole; wherein said first shaft portion extends into the thru hole of said first trip cam in order to couple said first shaft portion to said first trip cam; and wherein said second shaft portion extends into the thru hole of said second trip cam in order to couple said second shaft portion to said second trip cam.

8. The multi-pole electrical switching apparatus of claim 7 wherein said first housing member is a first cover; wherein said second housing member is a first base; wherein said housing assembly further comprises a second cover and a second base; wherein said first cover is coupled to said second base; wherein said first base is coupled to said second cover; wherein said first trip cam is disposed internal with respect to said first cover and said second base; and wherein said second trip cam is disposed internal with respect to said first base and said second cover.

9. The multi-pole electrical switching apparatus of claim 8 wherein said multi-pole electrical switching apparatus further comprises only one single coupling member extending though said second base, said first cover, said first base, and said second cover in order to couple said second base, said first cover, said first base, and said second cover together.

10. The multi-pole electrical switching apparatus of claim 9 wherein said first base has a first latching portion; and wherein said first cover has a second latching portion interlocked with said first latching portion.

11. The multi-pole electrical switching apparatus of claim 10 wherein said first base comprises a body portion; wherein said first latching portion is a pocket defined in said body portion; wherein said first cover comprises a body portion; wherein said second latching portion comprises an extension portion and a hook portion extending from said extension portion; wherein said extension portion extends outwardly from said body portion of said first cover away from said second base; and wherein said hook portion extends into the pocket.

12. The multi-pole electrical switching apparatus of claim 8 wherein each of said first cover and said first base comprises an internal portion and an external portion; wherein the external portion of each of said first cover and said first base comprises a tubular-shaped surface and a disc-shaped surface extending from the tubular-shaped surface and being disposed generally perpendicular with respect thereto; and wherein said bearing portion is structured to engage the tubular-shaped surface and the disc-shaped surface of said first cover and said first base.

13. The multi-pole electrical switching apparatus of claim 12 wherein said bearing portion is disc-shaped; and wherein said bearing portion extends radially outwardly from said first shaft portion and said second shaft portion.

14. The multi-pole electrical switching apparatus of claim 12 wherein said first shaft portion extends through the disc-shaped surface of said first cover; wherein said second shaft portion extends through the disc-shaped surface of said first base.

15. The multi-pole electrical switching apparatus of claim 8 wherein said bearing portion is not disposed internal with respect to said first cover and said second base; and wherein said bearing portion is not disposed internal with respect to said first base and said second cover.

16. A multi-pole electrical switching apparatus comprising:

a housing assembly comprising a first housing member and a second housing member coupled to said first housing member; and a trip cam assembly comprising:

a first trip cam, a second trip cam, and an interconnect member coupled to said first trip cam and said second trip cam, said interconnect member extending through said first housing member and said second housing member, wherein said first trip cam, said second trip cam, and said interconnect member have a common axis of rotation; wherein said first housing member is a first cover; wherein said second housing member is a first base; wherein said housing assembly further comprises a second cover and a second base; wherein said first cover is coupled to said second base; wherein said first base is coupled to said second cover; wherein said first trip cam is disposed internal with respect to said first cover and said second base; wherein said second trip cam is disposed internal with respect to said first base and said second cover; wherein said interconnect member comprises a first shaft portion, a second shaft portion, and a bearing portion extending from said first shaft portion to said second shaft portion; wherein said first shaft portion is coupled to said first trip cam; wherein said second shaft portion is coupled to said second trip cam; wherein said first shaft portion does not extend through said first base; and wherein said second shaft portion does not extend through said first cover.

17. The multi-pole electrical switching apparatus of claim 7 wherein said multi-pole electrical switching apparatus is devoid of one-pole coupling members.

* * * * *